US007698895B2

(12) United States Patent
Bretfeld et al.

(10) Patent No.: US 7,698,895 B2
(45) Date of Patent: Apr. 20, 2010

(54) PYROTECHNIC ACTUATOR

(75) Inventors: Anton Bretfeld, Fuerth (DE); Uwe Albrecht, Nuremberg (DE); Bernhard Lang, Feucht (DE)

(73) Assignee: Delphi Technologies, Inc., Troy, MI (US)

( * ) Notice: Subject to any disclaimer, the term of this patent is extended or adjusted under 35 U.S.C. 154(b) by 357 days.

(21) Appl. No.: 11/633,714

(22) Filed: Dec. 5, 2006

(65) Prior Publication Data

US 2007/0119173 A1 May 31, 2007

(30) Foreign Application Priority Data

Jul. 23, 2004 (DE) ..... 10 2004 035 918
Jul. 21, 2005 (WO) ..... PCT/EP2005/007987

(51) Int. Cl.
*F01B 29/08* (2006.01)
*F02N 13/00* (2006.01)

(52) U.S. Cl. ..... 60/636; 60/637; 60/632

(58) Field of Classification Search ..... 60/632, 60/636, 637, 638; 280/806
See application file for complete search history.

(56) References Cited

U.S. PATENT DOCUMENTS 2,892,452 A * 6/1959 Weinstock ..... 60/637
3,112,670 A * 12/1963 Litz, Jr. ..... 89/1.14
3,149,456 A * 9/1964 Sterrett ..... 60/637
3,180,082 A * 4/1965 Benditt et al. ..... 60/638
4,028,990 A * 6/1977 Waide ..... 89/1.14
4,091,621 A * 5/1978 Patrichi ..... 60/635
4,860,698 A * 8/1989 Patrichi et al. ..... 123/24 R
6,272,942 B1 * 8/2001 Ganser ..... 74/425
6,454,306 B1 * 9/2002 Cunningham et al. ..... 280/806
6,602,704 B1 * 8/2003 Maxwell et al. ..... 435/305.4
6,942,261 B2 * 9/2005 Larsen et al. ..... 293/107
7,296,504 B2 * 11/2007 Borg et al. ..... 89/1.14

FOREIGN PATENT DOCUMENTS

EP 1418121 A1 * 5/2004

* cited by examiner

*Primary Examiner*—Thomas E Denion
*Assistant Examiner*—Christopher Jetton
(74) *Attorney, Agent, or Firm*—Jimmy L. Funke

(57) ABSTRACT

The invention relates to an actuator comprising an actuator element movably supported at an actuator housing, a pyrotechnic pressure element to move the actuator element and a control means to control a force exerted onto the actuator element by the pressure element to move the actuator element.

12 Claims, 8 Drawing Sheets

PYROTECHNIC ACTUATOR

FIELD OF THE INVENTION

The invention relates to an actuator comprising an actuator element movably supported at an actuator housing and a pyrotechnic pressure element to move the actuator element.

BACKGROUND OF THE INVENTION

An actuator of this type is generally known and is used, for example, to interrupt electrical connections or to trigger fast switching procedures, e.g. in the motor vehicle safety sector.

The pyrotechnic pressure element, which is also called a pyrotechnic igniter in the case of an electrical activation, has the advantage in addition to a particularly fast power development that the energy required to move the actuator element can be stored without pressure over a long period of time by means of suitable chemical substances and can be released as required by means of a comparatively small electrical or mechanical energy.

An activation of the pressure element triggers a conversion of the chemical substances and results in the generation of a pressure impulse by which the actuator element is moved relative to the actuator housing, e.g. is pushed out of it. Since the action on the actuator element takes place very abruptly, the actuator element is moved in a short time and in an uncontrolled manner from a starting position into an end position.

This fast and uncontrolled movement of the actuator element has proved to be disadvantageous in those applications in which the movement procedure of the actuator element should endure for a specific time and/or a bounce of the actuator element should be avoided, e.g. in locking or unlocking processes.

It is the underlying object of the invention to provide a pyrotechnic actuator, wherein the movement of the actuator takes place in a controlled manner.

An actuator having the features of claim 1 is provided to satisfy this object.

The actuator in accordance with the invention comprises an actuator element movably stored at an actuator housing, a pyrotechnic pressure element for the movement of the actuator element and a control means for the control of a force exerted onto the actuator element by the pressure element to move the actuator element.

The force exerted on the actuator element on a triggering of the pressure element can be set by the control means such that the movement of the actuator element takes place at a desired speed. The control means is in particular adjustable such that the movement of the actuator element takes place over a desired period and/or a bounce of the actuator element is avoided. A defined movement of the actuator element can therefore be pre-set by the control means and a matching of the actuator to its respective area of use is possible.

Advantageous embodiments of the invention can be seen from the dependent claims, from the description and from the drawing.

SUMMARY OF THE INVENTION

In accordance with a preferred embodiment, the control means is arranged between the pressure element and the actuator element. It is thereby achieved that the gas pressure generated by the pyrotechnic pressure element does not build up abruptly, but increasingly in front of a surface of the actuator element which is to be acted on. This contributes to a yet more controlled movement of the actuator element.

The control means advantageously includes a diaphragm. This represents a particularly simple form of a control means. On an activation of the pressure element, a high-pressure system is created in front of the diaphragm, i.e. on the pressure element side of the diaphragm, and a low-pressure system is created behind the diaphragm, i.e. on the actuator element side of the diaphragm. By a suitable selection of the diaphragm cross-section, the pressure build-up in the low-pressure system, i.e. the pressure increase gradient, and thus ultimately the resulting force acting on the actuator element, can be set. In other words, the cross-section of the diaphragm forms a control parameter of the control means.

The diaphragm is preferably integrated into a spacer means for the pressure element. The spacer means serves for the correct positioning of the pressure element in the actuator housing. The spacer means satisfies a dual function by the simultaneous integration of the diaphragm, whereby the number of the components is reduced and the design of the actuator is simplified.

In accordance with a further embodiment, grouting is provided for the pressure element. In the event of an activation of the pressure element, the grouting brings about a more uniform conversion of the chemical substances contained in the pressure element and thus results in a more uniform gas pressure. Ultimately, a more uniform action on the actuator element and consequently an even more controlled movement of the actuator element is thereby achieved.

In accordance with an advantageous embodiment, the actuator element is fixed in a starting position by a grouting element. The grouting element satisfies a dual function in that it forms grouting for the pressure element, on the one hand, and provides a fixing of the actuator element, on the other hand. The design of the actuator is thereby simplified even further.

The grouting element preferably has a shear section which cooperates with the actuator housing such that a substantial movement of the actuator element relative to the actuator housing is only possible after a shearing of the shear section off the grouting element. For example, the shear section can be supported at a shoulder of the actuator housing in a starting position of the actuator element.

Due to the shear section, the actuator element is not set in motion immediately on an activation of the pressure element, but a pressure must first build up at the side of the actuator element to be acted on, said pressure being sufficient to shear off the shear section of the grouting element. A force threshold is created in this manner below which no movement of the actuator element takes place. It is thereby ensured that the force which acts on the actuator element and which the actuator element can in turn apply is not lower than a minimum force.

In accordance with a further advantageous embodiment, a holding device is provided to hold the actuator element in an end position after a movement by the pressure element. The holding device has the effect that the actuator element cannot be simply returned back into its starting position from its end position after a triggering of the actuator. In other words, the movement of the actuator element is irreversible.

The holding device can include a knurling of the actuator element which is pressed into a bore of the actuator housing on a movement of the actuator element. Alternatively or additionally, the holding device can include a friction-retaining slope of the actuator housing in which the actuator element jams on its movement. Both variants represent a particularly simple form of a holding device for the actuator element and thus contribute to a simple design of the actuator.

The actuator element is preferably formed by a piston displaceably supported in the actuator housing. Generally, however, other designs of the actuator element are also conceivable; the actuator element could e.g. be made in the manner of a lever and could be pivoted in the event of a triggering of the pressure element.

DESCRIPTION OF THE DRAWINGS

The invention will be described in the following purely by way of example with reference to advantageous embodiments and to the enclosed drawing. There are shown.

DETAILED DESCRIPTION OF THE INVENTION

Figure 1:
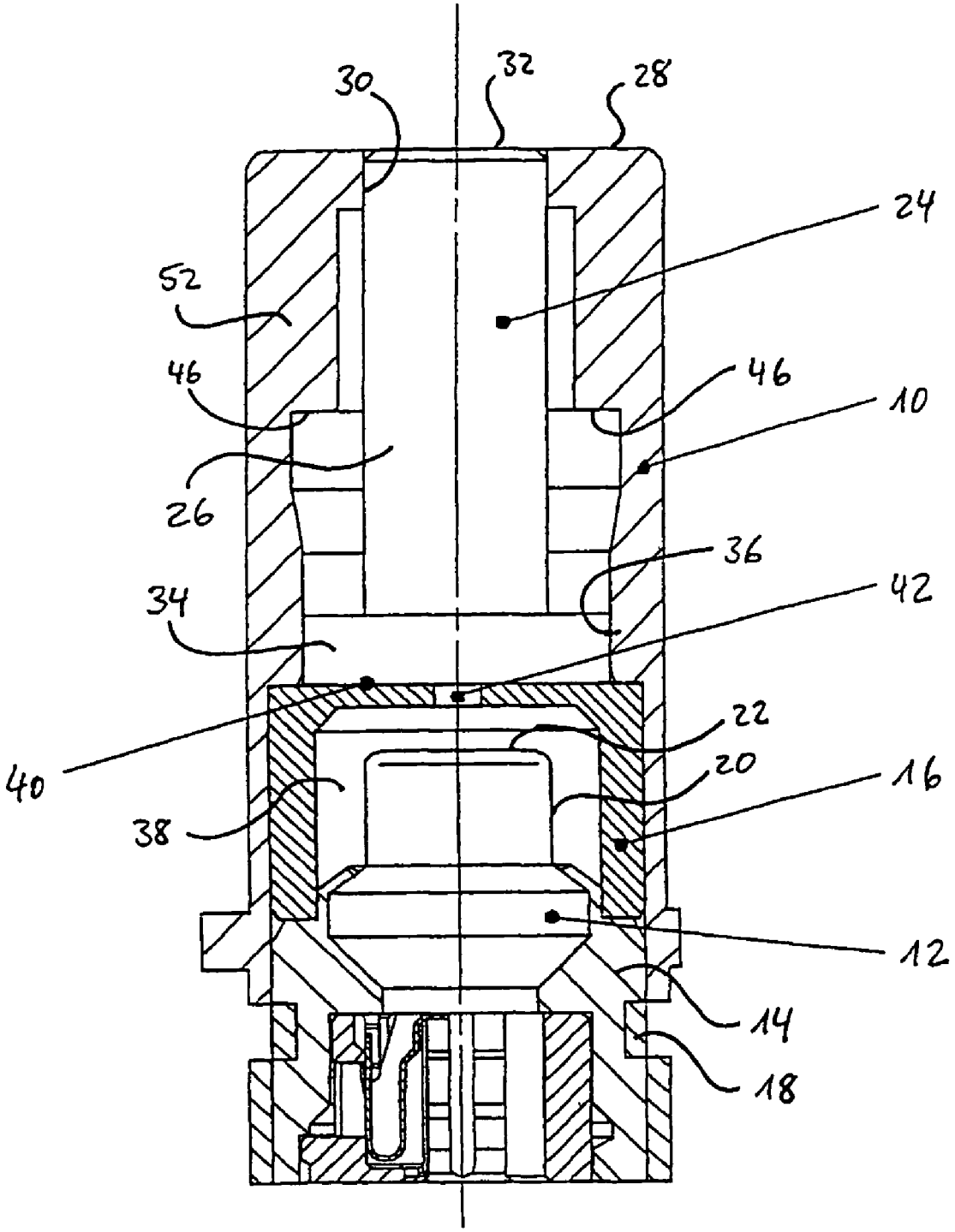
FIG. 1 a cross-sectional view of a first embodiment of the actuator in accordance with the invention in a starting state.
Figure 2:
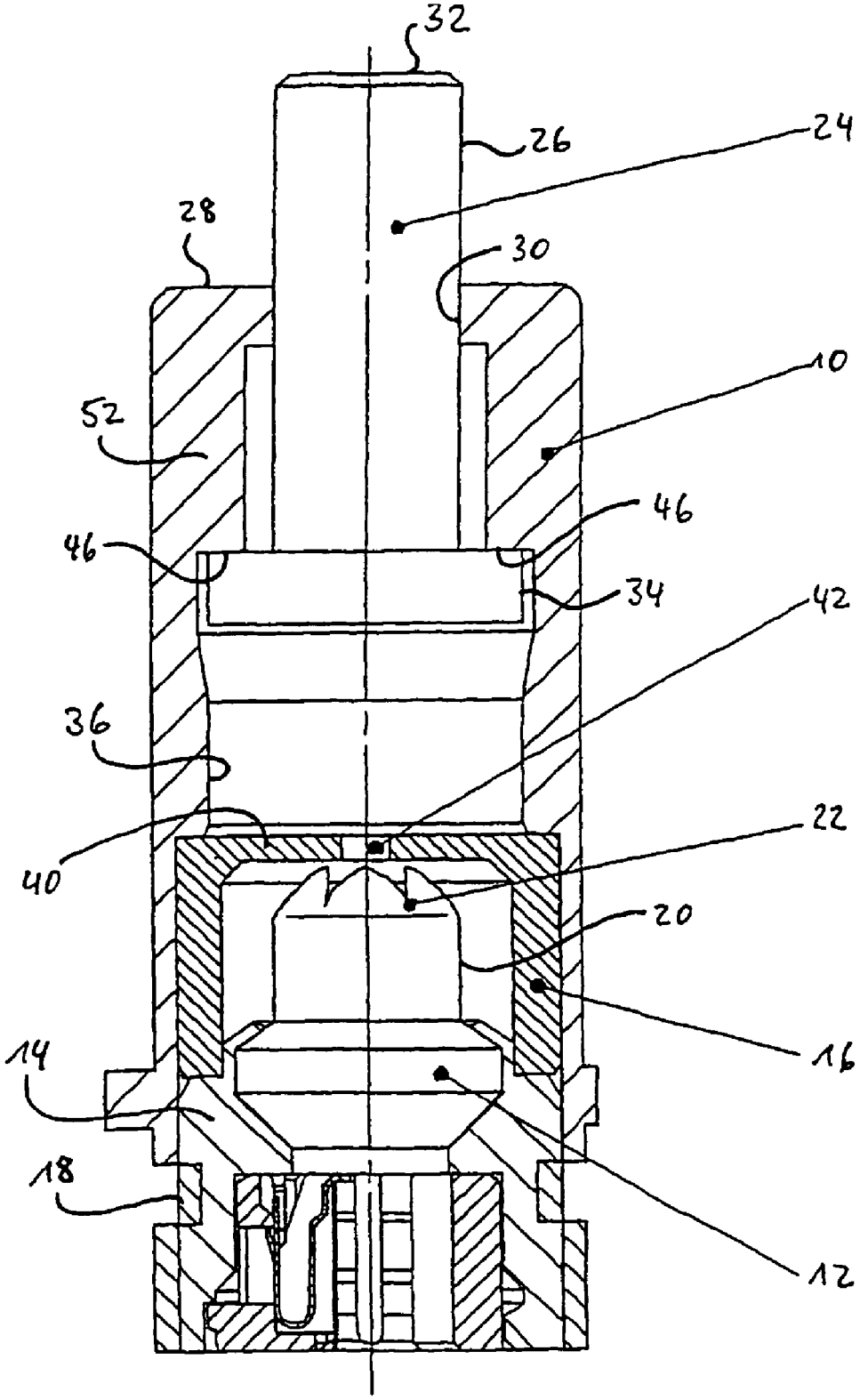
FIG. 2 a cross-sectional view of the actuator of FIG. 1 in a triggered state.

A first embodiment of the pyrotechnic actuator in accordance with the invention is shown in FIGS. 1 and 2.

The actuator has an actuator housing 10 in which a pyrotechnic pressure element 12 is arranged. The pressure element 12 is held by a pressure element carrier 14 in a rear region, a lower region in the Figure, of the actuator housing 10.

For the correct positioning of the pressure element carrier 14 in the actuator housing 10, a beaker-shaped spacer cup 16 is provided whose open side faces the pressure element carrier 14 and which surrounds the pressure element 12 at least regionally. The pressure element carrier 14 is fixed to the actuator housing 10 by means of a clinching connection 18.

Ignitable chemical substances are contained in the pyrotechnic pressure element 12 and can be brought to reaction, for example by electrical energy, on a triggering of the pressure element 12. Pressure elements of this type and suitable ignition mechanisms are sufficiently known.

A gas pressure impulse is created in the pressure element 12 by a fast conversion of the chemical substances and opens a cylindrical sleeve 20 of the pressure element 12 projecting into the spacer cup 16. Desired break points, e.g. in the form of stampings, are provided at the end face 22 of the sleeve 20 to ensure an opening of the sleeve 20 at the end face.

The pressure element 12 serves for the actuation of an actuator element 24 which is arranged in a front region, an upper region in the Figure, of the actuator housing 10. The actuator element 24 has the shape of a piston which is supported displaceably in the axial direction in the actuator housing 10.

The piston 24 includes a cylindrical main section 26 which is guided in a bore 30 provided at a front end face 28 of the actuator housing 10. As FIG. 1 shows, a front end face 32 of the piston 24 terminates in a flush manner with the front end face 28 of the actuator housing 10 in the starting state of the actuator.

In the region of the rear end of the main section 26, the piston 24 has a disk-shaped head section 34 which is guided, in a starting position of the piston 24, by a wall section 36 of the actuator housing 10 and terminates with it in a substantially gas-tight manner (FIG. 1).

When the pressure element 12 is ignited, a gas pressure is built up in the pressure element 12 by the reaction of the chemical substances located in the pressure element 12 which results in an opening of the sleeve 20 of the pressure element 12. The gas created can flow out of the pressure element 12 through the opening of the sleeve 20 and build up a gas pressure in a space 38 bounded by the spacer cup 16 and the pressure element 12 or the pressure element carrier 14.

As FIG. 1 shows, the piston head section 34 is disposed at a base 40 of the spacer cup 16 in the starting position of the piston 24. An opening 42 is provided in the base 40 of the spacer cup 16 through which the gas generated can flow through and can act on the head section 34 of the piston 24. The piston 24 is thereby moved away from the spacer cap 16 and pushed to the front out of the actuator housing 12.

The base 40 and the opening 42 of the spacer cup 16 form a diaphragm on whose side facing the pressure element 12 a high-pressure system is formed and on whose side facing the piston 24 a low-pressure system is formed. The pressure build-up in the low-pressure system takes place in dependence on the diaphragm cross-section, i.e. on the diameter of the opening 42. The diaphragm cross-section therefore represents a control parameter via which the pressure increase gradient in the low-pressure system, and thus ultimately the force acting on the piston 24, can be set.

The displacement of the piston 24 is bounded by a shoulder 46 of the actuator housing 10 which forms an abutment for the head section 34 of the piston 24. FIG. 2 shows the piston 24 in an end position in which the piston 24 is maximally pushed out of the actuator housing 10 and the head section 34 abuts the shoulder 46 of the actuator housing 10.

Figure 3:
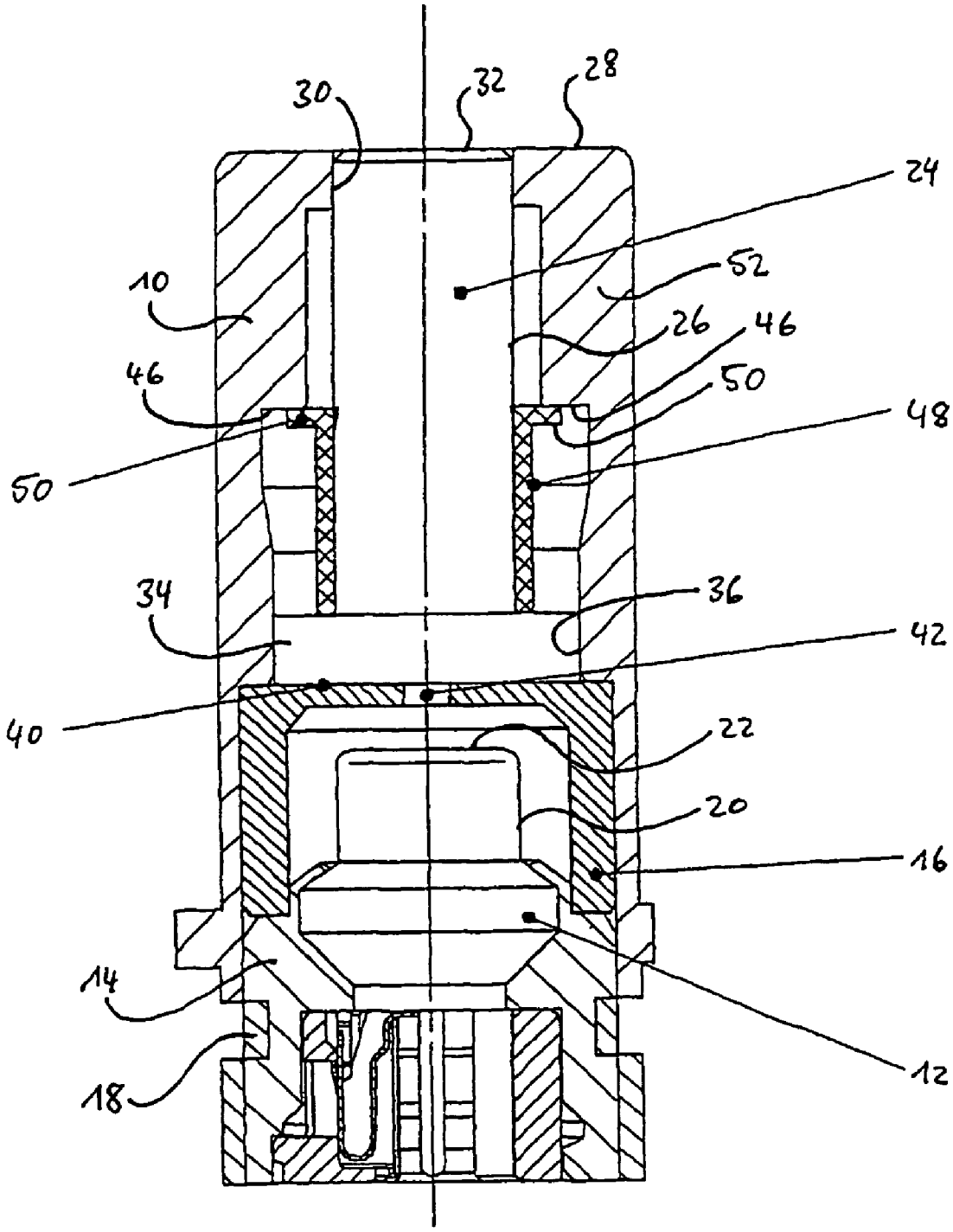
FIG. 3 a cross-sectional view of a second embodiment of the actuator in accordance with the invention in a starting state.
Figure 4:
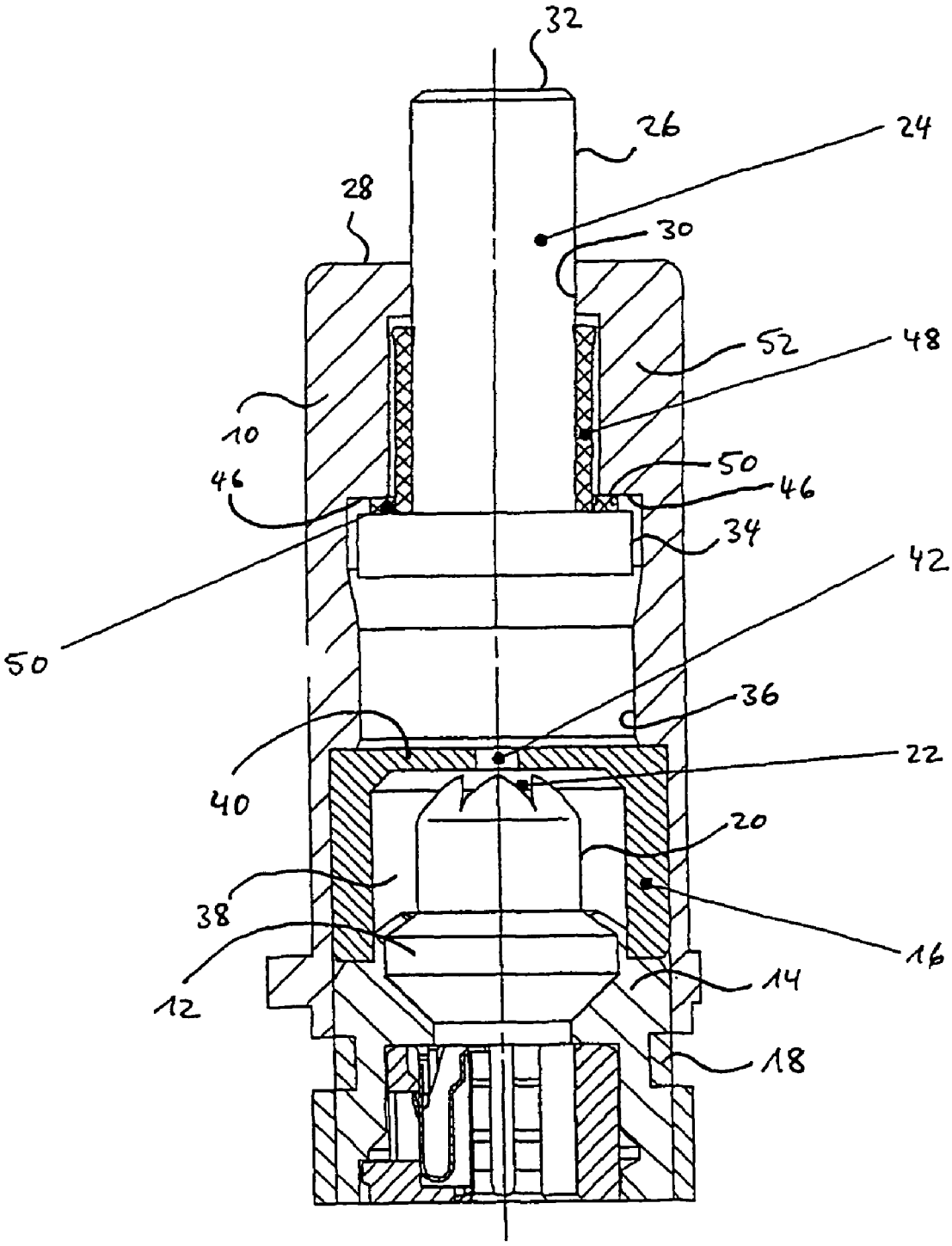
FIG. 4 a cross-sectional view of the actuator of FIG. 3 in a triggered state.

In FIGS. 3 and 4, a second embodiment of the actuator in accordance with the invention is shown which only differs from the first embodiment in that grouting is provided for the regularization of the conversion of the chemical substances of the pressure element 12 and of the gas pressure created in this process.

The grouting is achieved by a grouting element 48 which surrounds the main section 26 of the piston 24 like a sleeve. The grouting element 48 has an outwardly angled section 50 in the region of its front end facing away from the head section 34. As FIG. 3 shows, the grouting element 48 is dimensioned such that the angled section 50 cooperates with the shoulder 46 of the actuator housing 10 in the starting position of the piston 24 and is in particular supported at said shoulder. The grouting element 48 is therefore arranged between the head section 34 and the shoulder 46 viewed in the axial direction. The piston 24 is thereby fixed in the actuator housing 10 at its starting position and is prevented from a displacement relative to the actuator housing 10.

The angled section 50 of the grouting element 48 forms a shear section which has to be sheared off to permit a displacement of the piston 24 out of the actuator housing 10. The force required for the shearing off of the shear section 50 can be set by the selection of a corresponding material and/or of a corresponding geometry of the shear section 50, e.g. of the thickness of the shear section 50 and/or of the arrangement of desired break notches. An optimum grouting force and a particularly uniform realization of the chemical substances can be achieved in this manner. This permits the setting of a defined gas pressure and thus ultimately of a defined ejection force of the piston 24.

FIG. 4 shows the actuator in the triggered state, with the piston 24 being in its end position, i.e. being maximally pushed out of the actuator housing 10. As can be seen from the Figure, the head section 34 of the piston 24 does not directly abut the shoulder 46 of the actuator housing 10 in this case, but only indirectly via the sheared off shear section 50 disposed therebetween.

So that the movement of the piston 24 in the axial direction is not blocked by the part of the grouting element 48 remaining at the piston 24, the inner diameter of the section 52 of the actuator housing 10 disposed between the front end face 28 and the shoulder 46 has a width which is larger than an outer diameter of the grouting element 48 in the sheared-off state.

Figure 5:
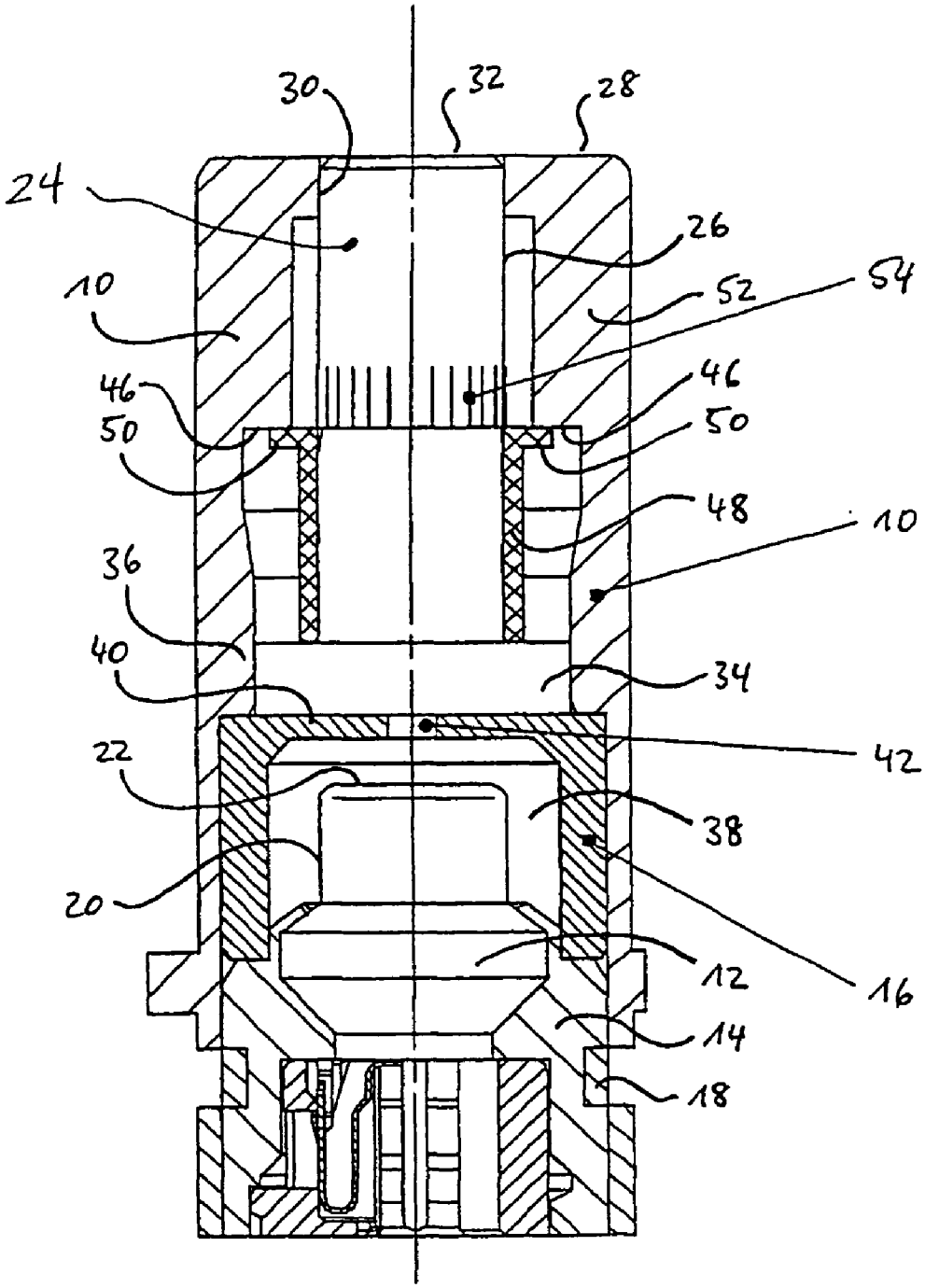
FIG. 5 a cross-sectional view of a third embodiment of the actuator in accordance with the invention in a starting state.
Figure 6:
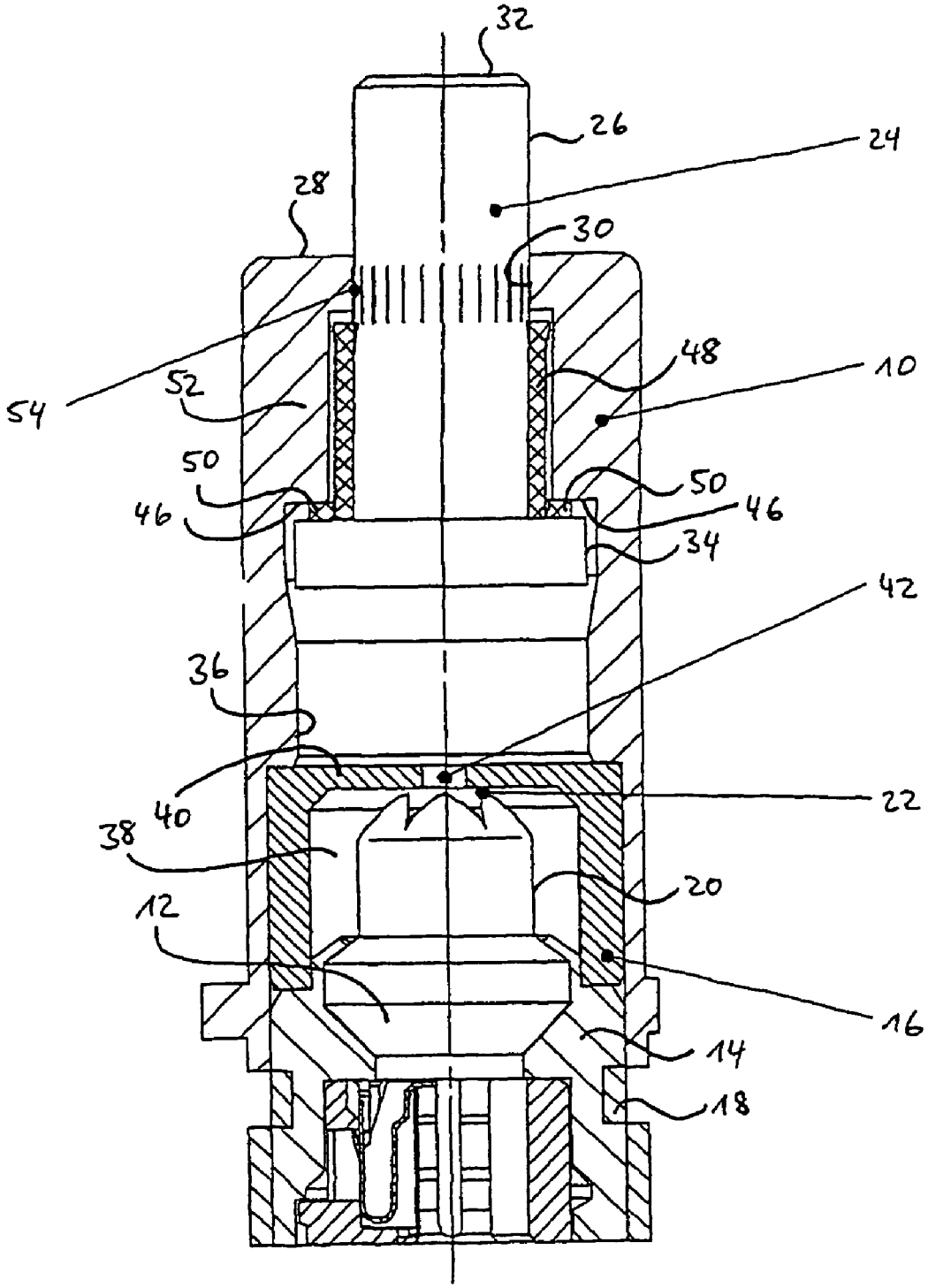
FIG. 6 a cross-sectional view of the actuator of FIG. 5 in a triggered state.

In FIGS. 5 and 6, a third embodiment of the actuator in accordance with the invention is shown which only differs from the second embodiment in that the main section 26 of the piston 24 is provided with a knurling 54.

The knurling 54 is positioned in a region of the main section 26 in the center viewed in the axial direction such that it is pressed into the bore 30 of the front end face 28 of the actuator housing 10 on the ejection of the piston 24. The knurling 54 is furthermore made such that an optimum pressing is present when the piston 24 has reached its end position, i.e. has been maximally pushed out of the actuator housing 10 (FIG. 6).

The knurling 54 pressed into the bore 30 in a slight interference fit and prevents the piston 24 fully pushed out of the actuator housing 10 from being able to be pushed back into the actuator housing 10. The actuator in accordance with the third embodiment therefore represents an irreversible system in which the piston 24 can admittedly be moved out of the actuator housing 10, but cannot be pushed back into it.

The term "irreversible" in this connection is to be understood such that the movement of the piston 24 cannot be reversed at least when forces are applied which occur in the normal use of the actuator. Unlike with the actuators in accordance with the first and second embodiments, the piston 24 of the actuator in accordance with the third embodiment can therefore not easily be pushed back into its starting position.

Figure 7:
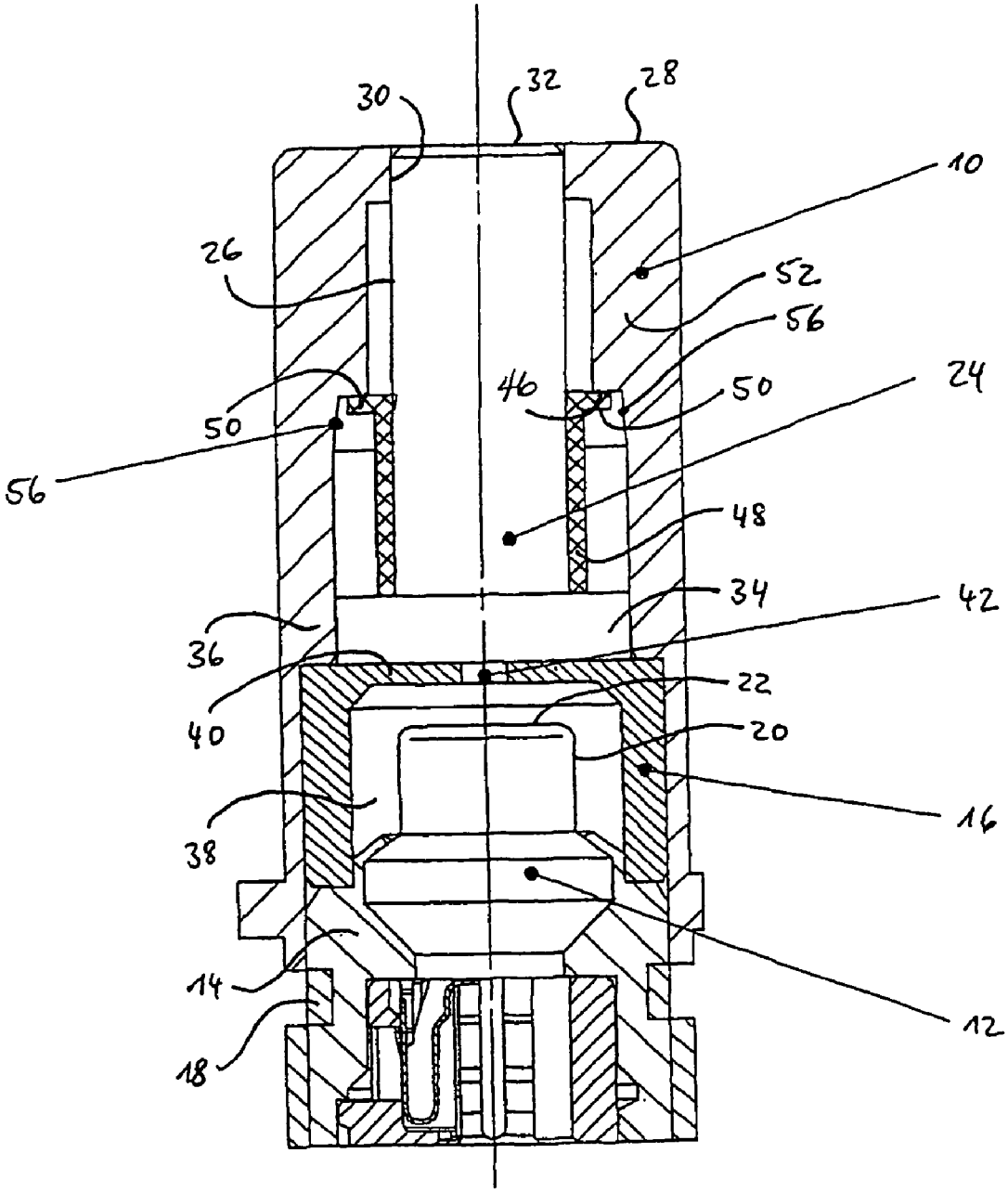
FIG. 7 a cross-sectional view of a fourth embodiment of the actuator in accordance with the invention in a starting state.
Figure 8:
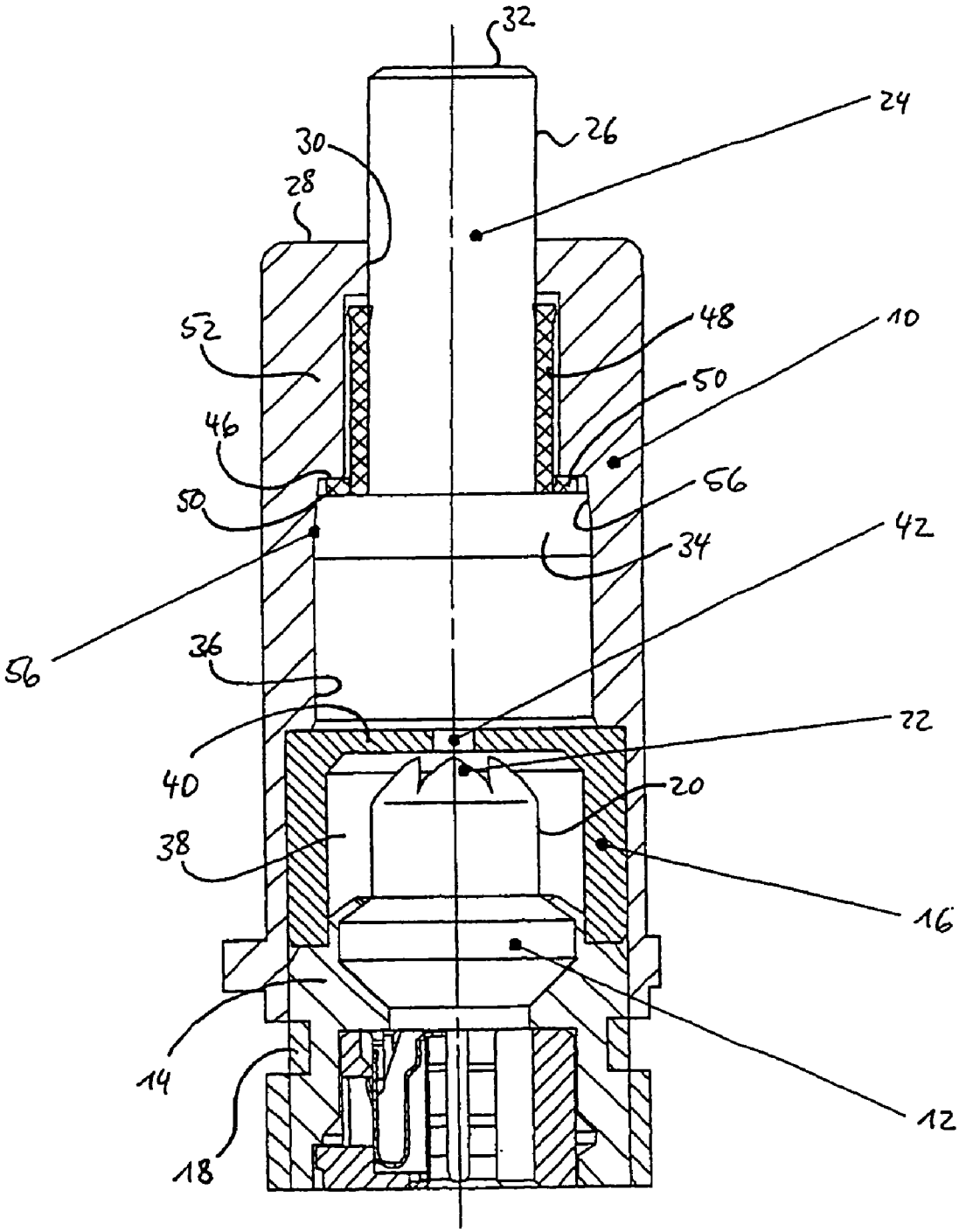
FIG. 8 a cross-sectional view of the actuator of FIG. 7 in a triggered state.

In FIGS. 7 and 8, a fourth embodiment of the actuator in accordance with the invention is shown which only differs from the third embodiment in that, instead of the knurling 54, a friction-retaining sloping surface 56 is provided in which the piston 24 jams when moving out. The sloping surface 56 is formed at the inner side of the actuator housing 10 in front of the shoulder 46, when viewed in the ejection direction of the piston 24, such that an optimal jamming of the head section 34 is achieved when the piston 24 has reached its end position, i.e. has moved maximally out of the actuator housing 10 (FIG. 8). As in the third embodiment, the completely moved out piston 24 can no longer be moved back into the actuator housing 10 so that it is also an irreversible actuator in the fourth embodiment.

The invention claimed is:

1. An actuator comprising an actuator element movably supported at an actuator housing, a pyrotechnic pressure element to move the actuator element and a control means to control a force exerted onto the actuator element by the pressure element to move the actuator element, said control means including a spacer cup base disposed within said housing intermediate said pressure element and actuator element, and forming a fixed, reduced diameter opening operative to establish a pressure drop thereacross, said actuator further comprising a grouting element arranged between the actuator element and the actuator housing, wherein the grouting element has a shear section which cooperates with the actuator housing such that a substantial movement of the actuator element relative to the actuator housing is only possible after a shearing of the shear section from the grouting element, wherein said grouting element has a generally cylindrical portion disposed concentrically with said piston main portion and extending continuously axially between a leading surface of said piston head section and a radially extending shoulder formed in said actuator housing, said frangible radially extending shear section abutting the actuator housing shoulder, wherein the generally cylindrical portion of said grouting element remains in situ with the piston main portion as it traverses between the retracted position and extended position, and wherein the generally cylindrical portion of said grouting element carried with the piston main portion has an outer diameter surface which is axially spaced from an adjacent inner diameter surface of said stepped housing bore.

2. An actuator in accordance with claim 1, wherein the control means comprises a diaphragm.

3. An actuator in accordance with claim 2, wherein the diaphragm is integrated into a spacer means for the pressure element.

4. An actuator in accordance with claim 2, wherein the diaphragm comprises an opening in a spacer cup for the pressure element and in particular in a base of the spacer cup.

5. An actuator in accordance claim 1, wherein grouting is provided for the pressure element.

6. An actuator in accordance with claim 1, wherein the actuator element is fixed in a starting position by said grouting element.

7. An actuator in accordance with claim 1, wherein shear section is supported at a shoulder of the actuator housing in a starting position of the actuator element.

8. An actuator in accordance with claim 1, further comprising a holding device provided to hold the actuator element in an end position after a movement by the pressure element.

9. An actuator in accordance with claim 8, wherein the holding device includes a knurling of the actuator element which is pressed into a bore of the actuator housing on a movement of the actuator element.

10. An actuator in accordance with claim 8, wherein the holding device includes a friction-retaining sloping surface of the actuator housing in which the actuator element jams on its movement.

11. An actuator in accordance with claim 1, wherein the actuator element is formed by a piston displaceably supported in the actuator housing.

12. A pyrotechnic actuator comprising:

a substantially cylindrical actuator housing;

an actuator piston supported for limited axial displacement within said housing between a retracted position and an extended position, said actuator piston including a relatively large diameter head section centrally displaced within said housing and a relatively small diameter main section extending axially outwardly therefrom through a stepped bore in said housing;

a pyrotechnic pressure element;

a spacer cup fixedly mounted within said housing;

a pressure element carrier fixedly mounted within said housing and cooperating with said spacer cup to define a high pressure cavity enclosing said pyrotechnic pressure element, said spacer cup defining a base having a fixed, relatively small diameter opening therein communicating with a low pressure cavity defined by said base, an adjacent inner diameter surface of said housing and said piston head section to control force exerted on the actuator piston;

means operative to releasably retain said piston in a retracted position prior to ignition of said pyrotechnic pressure element; and means operative to axially retain said piston in a fully extended position following ignition of said pyrotechnic pressure element, wherein said means operative to releasably retain said piston in a retracted position comprises a grouting element having a generally cylindrical portion disposed concentrically with said piston main portion and extending continuously axially between a leading surface of said piston head section and a radially extending shoulder formed in said actuator housing, said grouting element having a frangible radially extending shear section abutting the actuator housing shoulder such that a substantial movement of the actuator element relative to the actuator housing is only possible after a shearing of the shear section from the cylindrical portion of the grouting element, and wherein the generally cylindrical portion of said grouting element remains in situ with the piston main portion as it traverses between the retracted position and extended position, and wherein the generally cylindrical portion of said grouting element carried with the piston main portion has an outer diameter surface which is axially spaced from an adjacent inner diameter surface of said stepped housing bore.

* * * * *